US006203663B1

(12) United States Patent
Kamps et al.

(10) Patent No.: US 6,203,663 B1
(45) Date of Patent: Mar. 20, 2001

(54) DECORATIVE FORMATION OF TISSUE

(75) Inventors: Richard Joseph Kamps, Wrightstown; Janica Sue Behnke; Fung-jou Chen, both of Appleton; Darnell Clarence Radtke, Shiocton, all of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 08/435,700

(22) Filed: May 5, 1995

(51) Int. Cl.[7] ..... D21F 11/00

(52) U.S. Cl. ..... 162/109; 162/112; 162/113; 162/116; 162/123; 162/126; 162/129; 162/130

(58) Field of Search ..... 162/109, 111, 162/112, 113, 116, 123, 126, 129, 130

(56) References Cited

U.S. PATENT DOCUMENTS

| | | | |
|---|---|---|---|
| 1,616,222 | 2/1927 | Harrigan . | |
| 1,687,140 | 10/1928 | Pleyer . | |
| 3,230,136 | 1/1966 | Krake | 162/111 |
| 3,309,265 | 3/1967 | Krake | 162/348 |
| 3,322,617 | 5/1967 | Osborne | 162/296 |
| 4,467,839 | 8/1984 | Westhead | 139/383 A |
| 4,529,480 | 7/1985 | Trokhan | 162/109 |
| 4,541,895 | 9/1985 | Albert | 162/348 |
| 4,637,859 | 1/1987 | Trokhan | 162/109 |
| 4,759,391 | 7/1988 | Waldvogel et al. | 139/383 A |
| 4,967,805 | 11/1990 | Chiu et al. | 139/383 A |
| 5,169,709 | 12/1992 | Fleischer | 428/225 |
| 5,178,729 * | 1/1993 | Janda | 162/130 |
| 5,211,815 | 5/1993 | Ramasubramanian et al. | 162/348 |
| 5,277,761 * | 1/1994 | Phan et al. | 162/109 |
| 5,328,565 | 7/1994 | Rasch et al. | 162/113 |
| 5,409,572 * | 4/1995 | Kershaw et al. | 162/112 |

FOREIGN PATENT DOCUMENTS

| | | | |
|---|---|---|---|
| 1 461 082 | 5/1965 | (DE) . | |
| 0 312 512 | 4/1989 | (EP) | D21F/11/04 |
| 24085 * | 11/1893 | (GB) | 162/116 |
| 1 008 703 | 11/1965 | (GB) . | |
| 1 117 731 | 6/1968 | (GB) | D21H/1/02 |
| 6-287883 | 10/1994 | (JP) . | |
| WO9014465 | 11/1990 | (WO) . | |
| WO9300474 | 1/1993 | (WO) . | |

* cited by examiner

*Primary Examiner*—Peter Chin
(74) *Attorney, Agent, or Firm*—Gregory E. Croft

(57) ABSTRACT

Paper sheets, such as tissue sheets useful for facial tissue, bath tissue and the like, are formed with a decorative pattern imparted to the tissue sheet by the forming fabric. The decorative pattern is incorporated into the forming fabric by a variety of means, such as stitching, silk screening, printing, weaving, or overlaying a fabric with a decorative pattern onto a conventional forming fabric. The presence of decoratively-shaped areas in the forming fabric, which are areas of relatively slow water drainage, cause corresponding areas in the resulting sheet to have a translucent appearance attributable to a relatively lower basis weight and/or different fiber composition. The decorative patterns are preferably formed in the outer or surface layer(s) of the paper sheet.

12 Claims, 16 Drawing Sheets

DECORATIVE FORMATION OF TISSUE

BACKGROUND OF THE INVENTION

Tissue products such as facial tissue, bath tissue, kitchen towels, dinner napkins and the like are often aesthetically enhanced by printing or embossing the surface of the tissue with decorative designs. Both printing and embossing are basesheet post treatments which increase operational costs and require additional capital equipment. An economical method of enhancing the aesthetic appeal of tissues which does not require additional equipment and additional web handling would be advantageous.

SUMMARY OF THE INVENTION

It has now been discovered that tissue sheets can be provided with decorative patterns by forming the tissue sheet on a forming fabric having a decorative pattern superposed thereon or incorporated therein. As a result of the different drainage characteristics of the portions of the forming fabric having the decorative pattern, the resulting tissue sheet exhibits a subtle, yet distinctive, translucent decorative pattern corresponding to the decorative pattern of the forming fabric. More particularly, areas of the forming fabric having a more restrictive flow (or no flow) will not retain the same quantity and type of fibers as the areas of the forming fabric having a less restrictive flow. As a consequence, by using a papermaking furnish containing relatively long fibers and relatively short fibers, a decorative pattern can be imparted into the newly-formed sheet in which the decorative pattern in the tissue is delineated by areas of different fiber composition (different fiber length) corresponding to areas of differing forming fabric drainage.

Hence, in one aspect, the invention resides in a tissue sheet having a distinct decorative pattern cast into the sheet during the initial formation of the sheet on a forming fabric, said tissue sheet comprising long papermaking fibers and short papermaking fibers, wherein the decorative pattern is defined by areas having a greater average fiber length and/or a lower basis weight than the surrounding adjacent area of the tissue sheet. For purposes herein, "long" fibers are fibers having an average fiber length greater than 0.7 millimeters, a weighted average fiber length of greater than 2.0 millimeters, and less than 8 million fibers per gram as measured using a Kajaani FS200 Fiber Analyzer. Virgin softwood fibers are typically long fibers. "Short" fibers are fibers and fines having an average fiber length of less than 0.7 millimeters, a weighted average fiber length of less than 1.2 millimeters, and greater than 15 million fibers per gram as measured using a Kajaani FS200 Fiber Analyzer. With some exceptions, virgin hardwood fibers are typically short fibers. However, secondary softwood fibers and refined softwood fibers can include a population of short fibers if the fiber length distribution of that population falls within the foregoing definition. In such instances, the decorative effect can be achieved with solely softwood fibers. All Kajaani measurements include the presence of fines.

In another aspect, the invention resides in a method of forming a tissue sheet comprising depositing an aqueous suspension of short fibers and long fibers onto a decorative forming fabric which contains areas of relatively slow drainage, the shapes of which areas define distinct decorative designs, wherein the forming fabric retains the fibers of the aqueous suspension of fibers as the water passes through the forming fabric, and wherein the long fibers are preferentially retained on the surface of the forming fabric in the decorative areas of relatively slow drainage. The newly-formed paper sheet is then further dewatered and dried.

More specifically, the invention resides in a method of making a tissue sheet comprising: (a) depositing a first aqueous suspension of papermaking fibers having a consistency of less than 5 weight percent onto a decorative forming fabric to form a first embryonic web, said first suspension of papermaking fibers containing at least about 50 dry weight percent short fibers; (b) depositing a second aqueous suspension of papermaking fibers onto a forming fabric of uniform appearance to form a second embryonic web, said second suspension of papermaking fibers containing at least about 50 dry weight percent long fibers; (c) dewatering and combining the first and second embryonic webs at a consistency of from about 20 to about 50 percent; and (d) drying the combined web to form a unitary, layered, decorative tissue sheet.

In a further aspect, the invention resides in a woven papermaking forming fabric having multiple spaced-apart areas of relatively slow drainage, the shapes of which areas define visually distinct decorative patterns.

The aqueous suspension of papermaking fibers can be introduced to the decorative forming fabric in several different ways. In all cases the consistency of the aqueous fiber suspension is 5 weight percent or less, more specifically from about 0.05 to about 2 weight percent, and still more specifically about 0.2 weight percent. For example, if using a single headbox, the aqueous fiber suspension can be layered or blended (non-layered). If blended, the papermaking fibers preferably comprise at least about 50 dry weight percent short fibers and at least about 20 dry weight percent long fibers. This combination of fibers provides a large number of short fibers which flow around the decorative design areas of the fabric having impeded drainage flow rates, thereby concentrating the short fibers in the high flow rate areas of the forming fabric to form corresponding areas in the resulting paper sheet of relatively higher basis weight and opacity. At the same time, there are a sufficient number of long fibers to bridge the decorative areas of slow drainage in the forming fabric and provide sufficient continuity and strength to the resulting web, even though the basis weight in the decorative areas of the sheet is relatively low.

If a layered headbox is used to deposit a layered aqueous suspension of fibers onto the forming fabric, a short fiber layer, or a layer containing predominantly short fibers, is advantageously deposited directly onto the decorative forming fabric to enable the relatively short fibers to follow the relatively fast drainage flows without the drainage of the fabric being altered by the collection of long fibers. The remaining layer(s) have greater amounts of long fibers, or can contain predominantly long fibers or consist entirely of long fibers. Some of the longer fibers end up bridging the slower-draining decorative areas of the forming fabric, while other long fibers cover the areas occupied by the short fiber layer.

If more than one headbox is used, such as when couch forming by combining two independently-formed wet webs, a predominantly short fiber-containing web can be formed on a decorative forming fabric while the other web containing a greater percentage of long fibers can be formed on a conventional forming fabric to provide a strength layer for the resulting layered paper sheet.

As used herein, a "decorative" forming fabric is a forming fabric having spaced-apart decorative (aesthetically pleasing) areas which are visually recognizable and distinct relative to the balance or continuum of the forming fabric. Each decorative area of the forming fabric is constructed to adorn and embellish the tissue or paper sheet formed thereon with a corresponding distinct, visually-discernable, aesthetically pleasing decorative indicia. These decorative indicia comprise straight and/or curvilinear lines on the surface of the fabric which are of relatively low or no drainage and which collectively form representations of things such as flowers, butterflies, leaves, animals, toys, monograms, words, fleur de lis, and the like. Alternatively, the decorative areas can be of other shapes such a lace, geometries, and the like. The decorative areas can be incorporated into the forming fabric by a variety of means which impart relatively slow removal of water within the decorative areas of the forming fabric. Such means include, but are not limited to, silk screening, stitching, applying a sealant, printing, overlaying a decorative fabric on top of a typical forming fabric to create a composite fabric, or by weaving a decorative pattern into the fabric, as can be done with a Jacquard loom.

The width of the lines which comprise the decorative areas depends upon the nature of the fiber furnish being used to form the tissue sheet and the type of layering of the furnish, if any. If a blended (nonlayered) furnish is being used to form the tissue sheet, then about 50 percent or greater of the fibers in the furnish must have a fiber length greater than the line width. If a layered furnish is being used to form the tissue sheet, in which a short fiber layer is being deposited onto the decorative forming fabric underneath a long fiber layer, then only about 25 percent or greater of the fibers in the furnish must have a fiber length greater than the line width. If the tissue is being formed by couching together separately-formed webs or by plying together separately formed plies, then there is no restriction on the length of the fibers relative to the line width. In all cases, the common purpose is to produce a decoratively-formed tissue sheet which has sufficient strength. In the case of a blended sheet, there must be sufficient long fibers in the furnish to bridge the line width to prevent holes from being formed in the sheet. At the other extreme, namely couch forming, the decoratively-formed web can afford to have holes or weak areas because it will be combined (couched) with a conventionally-formed web that imparts the necessary strength to the combined sheet. The furnish requirements for sheets formed using a single layered headbox fall in between the two extremes. In general, suitable line widths can be from about 0.02 to about 2 millimeters, more specifically from about 0.05 to about 1.5 millimeters. In addition, it is advantageous for the orientation of the majority of the lines of the decorative pattern to be substantially oriented parallel to the cross-machine direction of the sheet. Elongated decorative indicia should be aligned more toward the cross-machine direction than the machine direction. This orientation tends to retain more of the cross-machine direction tensile strength of the sheet, which is ordinarily much weaker than the machine direction tensile strength and therefore cannot afford significant strength loss.

The products of this invention are preferably layered in a manner in which the decorative portion of the web is formed into the outer or surface layer or layers. Because of the relatively lower basis weight created in the decorative areas, such decorative layers are relatively weak compared to a layer having a uniform, higher basis weight. Hence it is advantageous to provide a subsurface layer which serves to provide more strength to the tissue sheet. To this end at least one subsurface layer preferably contains at least about 50 dry weight percent long fibers, more specifically at least about 75 dry weight percent long fibers, and still more specifically about 100 dry weight percent long fibers. As is well known in the papermaking art, softwood fibers are longer than hardwood fibers and tend to impart greater strength to the tissue sheet. Depending on the strength requirements of the particular product, however, a decorative pattern can also be imparted to one or more of the subsurface or inner layers of the layered sheet.

On the other hand, the outer decorative layer or layers preferably contain at least about 50 dry weight percent short fibers, more specifically at least about 75 dry weight percent short fibers, and still more specifically about 100 dry weight percent short fibers. A high short fiber content is desireable because they are more likely than long fibers to follow the path of least resistance during formation and drainage. This results in areas of relatively low (or even zero) basis weight where the drainage is impeded, which occurs in the decorative areas of the forming fabric, and relatively higher basis weight elsewhere. Long fibers, by comparison, are less sensitive to the different drainage characteristics of the decorative forming fabric and are less prone to form the areas of differing basis weights that are necessary to create distinct decorative patterns in the sheet.

The decorative areas of the resulting sheet are relatively translucent compared to the balance or continuum of the sheet. As a result, a unique decorative effect can be obtained if one or both surface layers of the sheet are decoratively formed as described above and one or more subsurface layers are colored, as by dying the fibers. The color of the subsurface layer is more readily apparent in the decorative areas of the outer layer(s) and gives the appearance of a colored decorative pattern. Also, the decorative layer and the underlying layers can both be colored, but colored differently with different shades or intensities to also provide a unique decorative effect. Typically the underlying layer will be darker than the decorative outer layer.

The decoratively formed sheets of this invention can be dried by any suitable methods, including throughdrying or wet-pressing processes. The decoratively formed sheet can be creped or uncreped. Somewhat surprisingly, the decorative pattern survives the creping process and maintains a pleasing appearance in the creped sheet.

DETAILED DESCRIPTION OF THE DRAWING

Figure 1:
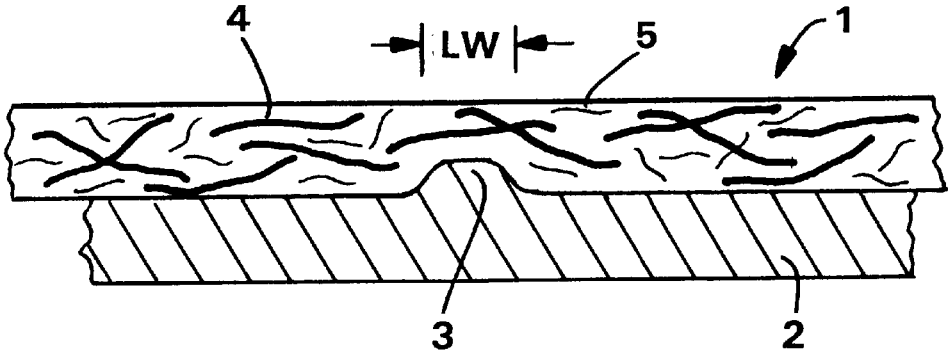
FIG. 1 is a schematic sectional view of a decoratively-formed sheet in accordance with this invention, illustrating the fiber composition and basis weight characteristics when formed from a blended furnish of long and short fibers.

Referring to FIG. 1, shown is a schematic sectional view of a blended paper sheet as it is formed on a decorative forming fabric in accordance with this invention, illustrating the difference in fiber composition and basis weight in the decorative areas of the sheet and the fabric. Shown is the wet sheet 1 supported by the decorative forming fabric 2. A cross-section of a decorative line which forms part of the decorative indicia on the forming fabric is represented by fabric protrusion 3, which schematically represents the cross-sectional area or zone through which drainage of the water is impeded relative to the remaining area of the forming fabric shown. The width of the line is indicated by the dimension "LW". As described earlier, means for impeding or retarding the drainage rate can be in the form of additional filaments on top of or within the forming fabric weave pattern, or it can be in the form of a film or a coating which blocks or fills void space within the fabric through which water could otherwise drain. It is not necessary that the decorative line actually protrude from the surface of the fabric as shown. For a blended fiber furnish containing long fibers 4 and short fibers 5, the fiber composition and basis weight will be generally uniform from the fabric side to the air side of the sheet, except for within the decorative area "LW", where the fiber composition is predominantly long fibers and where the basis weight is lighter (lower sheet caliper).

Figure 2:
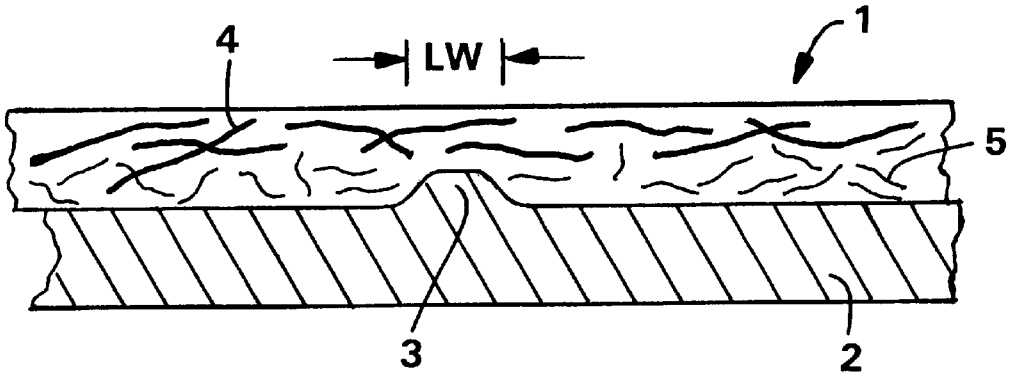
FIG. 2 is a schematic sectional view similar to that of FIG. 1, but for a sheet formed with a layered furnish.

FIG. 2 is similar to FIG. 1, but illustrating the fiber distribution and basis weight difference when forming a layered sheet from a single, layered headbox in which the fabric side layer is 100 percent short fibers and the air side layer is 100 percent long fibers. As with the blended furnish, the short fibers avoid the decorative area and migrate to either side where drainage is easier. The long fibers are less sensitive to the difference in drainage and some long fibers still are deposited in the decorative area.

Figure 3:
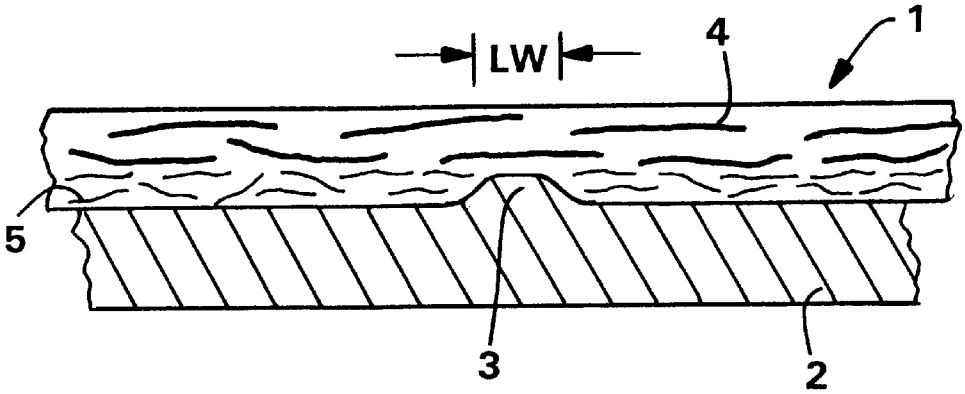
FIG. 3 is a schematic sectional view similar to that of FIGS. 1 and 2, but for a sheet formed by couching together a decoratively formed layer and a conventionally formed layer.

FIG. 3 is similar to FIG. 2, but illustrating the situation where a 100 percent long fiber web is conventionally-formed and superimposed (couched) while wet onto a decoratively-formed web of 100 percent short fibers. The result is as shown in FIG. 2, except the layer purity is 100 percent since the layers are separately formed and offer no opportunity for fiber mixing.

Figure 4:
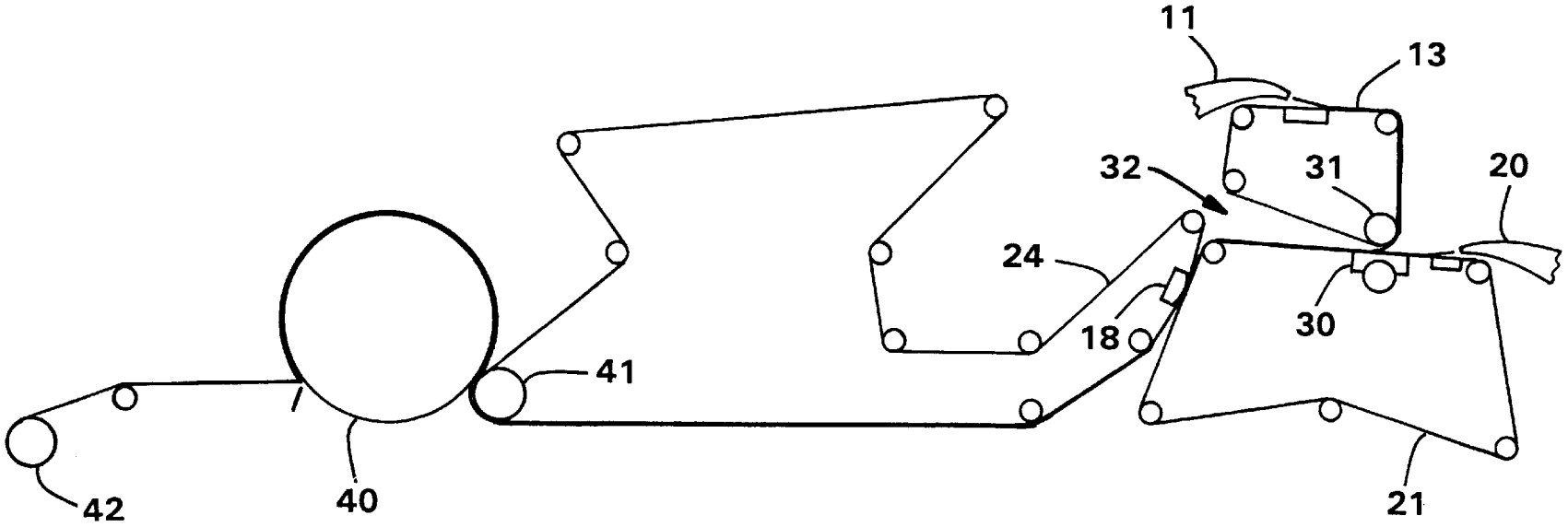
FIG. 4 is a schematic flow diagram of a wet-pressing couching process for making decorative tissue sheets in accordance with this invention.

Referring to FIG. 4, a method of making decorative tissues in accordance with this invention is illustrated in which two wet webs are couched together and thereafter dried and creped in a wet-pressing process. Many of the rolls used to define the various fabric runs are shown for the sake of completeness but are not individually described since they are not essential for practicing this invention and their function is readily apparent from the drawing. Shown is a first headbox 11 from which a first aqueous suspension of papermaking fibers having a consistency of about 0.2 weight percent is deposited on an endless forming fabric 13 to form a first wet embryonic web. Specific suitable forming fabrics include, without limitation: single layer fabrics, such as the Appleton Wire 94M available from Albany International Corporation, Appleton Wire Division, Menasha, Wis.; double layer fabrics, such as the Asten 866 available from Asten Group, Appleton, Wis.; and triple layer fabrics, such as the Lindsay 3080, available from Lindsay Wire, Florence, Miss.

A second headbox 20 deposits a second aqueous suspension of papermaking fibers having a consistency of about 0.2 weight percent onto an endless forming fabric 21 to form a second wet embryonic web. Suitable forming fabrics for forming fabric 21 include single layer fabrics such as Appleton Wire 84M, double layer fabrics such as the Asten 856, and triple layer fabrics such as the Lindsay 3070. Either the first or second forming fabric can be the decorative forming fabric.

After initial formation of the first and second wet webs, the two webs are brought together in contacting relationship (couched) while at a consistency of from about 10 to about 30 percent. Whatever consistency is selected, it is preferable that the consistencies of the two wet webs be substantially the same. Couching is achieved by bringing the first wet web into contact with the second wet web at vacuum suction box 30, after which time the first forming fabric 13 is peeled away at turning roll 31.

After the two webs have been couched together to form a consolidated web 32, the consolidated or couched web is transferred to a papermaking felt 24 with the aid of vacuum box 18. Dewatering, drying and creping of the consolidated web is achieved in the conventional manner. More specifically, the couched web is further dewatered and transferred to a Yankee dryer 40 using a pressure roll 41, which serves to express water from the web, which is absorbed by the felt, and causes the web to adhere to the surface of the Yankee. The web is then dried, creped and wound into a roll 42 for subsequent converting into the final creped product.

Figure 5:
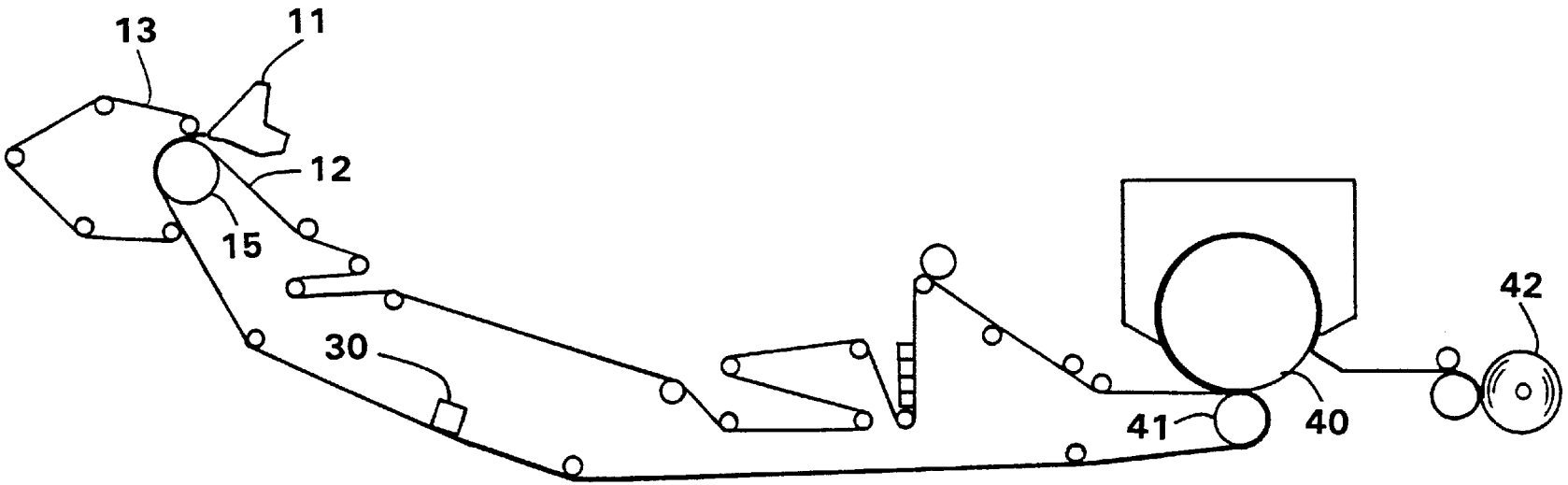
FIG. 5 is a schematic flow diagram of a wet-pressing process for making decorative tissue sheets in accordance with this invention using a single, layered headbox.

FIG. 5 illustrates another embodiment of this invention in which a wet-pressed tissue sheet is formed with a single, layered headbox in a forming configuration known as a crescent former. Shown is a headbox 11 from which an aqueous suspension of papermaking fibers at a consistency of about 0.2 weight percent is deposited between an endless papermaking felt 12 and an endless decorative forming fabric 13 to form a wet embryonic web. Both fabrics partially wrap a forming roll 15 such that the wet embryonic web is partially dewatered by flinging water through the forming fabric 13 due to centrifugal force and by the water absorbing properties of the felt. The wet web stays with the felt and is subsequently dewatered, dried and creped in a conventional manner as shown.

In all aspects of this invention, the web can be further processed by wet-pressing or throughdrying. If throughdried, it can be creped or uncreped.

EXAMPLES

Example 1

Figure 6:
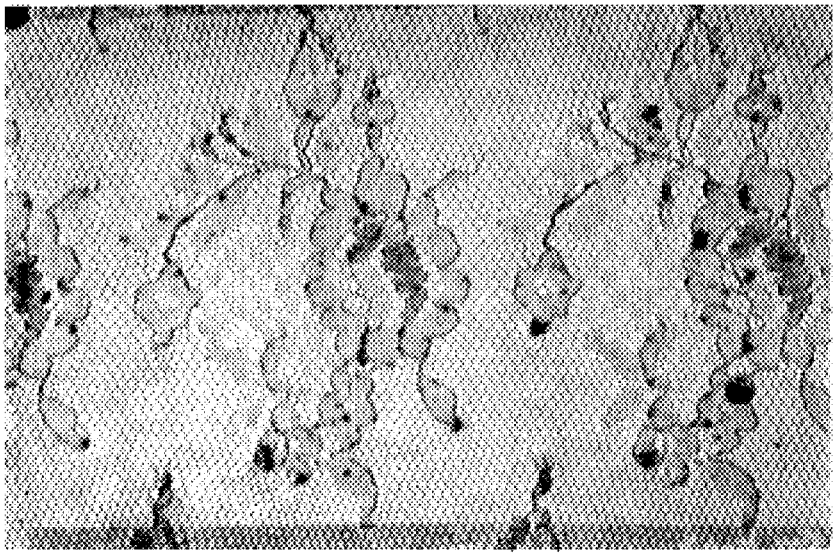
FIGS. 6–31 are plan views of decorative forming fabrics and the resulting tissues in accordance with this invention.

A thin lacy membrane was secured on top of a supporting fabric in a hand sheet mold. A slurry of 100 percent eucalyptus fiber was dispersed in the mold and the water slurry mixture was drained to form a hand sheet on the lacy membrane. The formed sheet was removed from the lace, pressed between plotter paper, and dried. The lacy membrane altered the drainage of the slurry, collecting a different basis weight of fiber representing the transposed image of the lace in the hand sheet. FIG. 6 is a photograph of the resulting hand sheet.

Example 2

Figure 7:
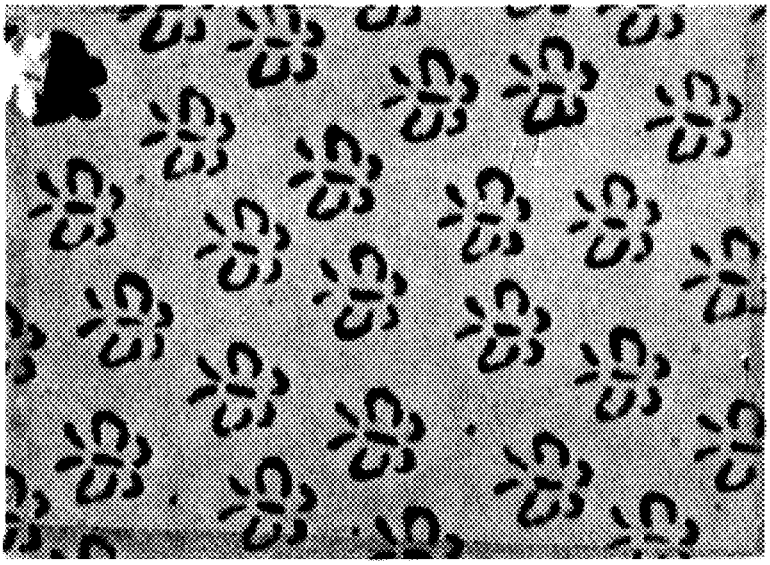

A second hand sheet sample was produced by sealing the hand sheet forming fabric with a latex resin in the design of discrete butterflies. A slurry of 100 percent eucalyptus fiber was dispersed in the hand sheet mold and the water slurry mixture was drained to form a hand sheet on the patterned forming fabric. The formed sheet was couched off the fabric with a plotter, pressed between plotter paper, and dried. The sealed lines on the fabric depicting the butterfly eliminated the drainage in that area of the fabric and collected no fiber in those design areas, resulting in totally open holes in the hand sheet depicting the butterfly design. FIG. 7 is a photograph of the resulting hand sheet.

Figure 8:
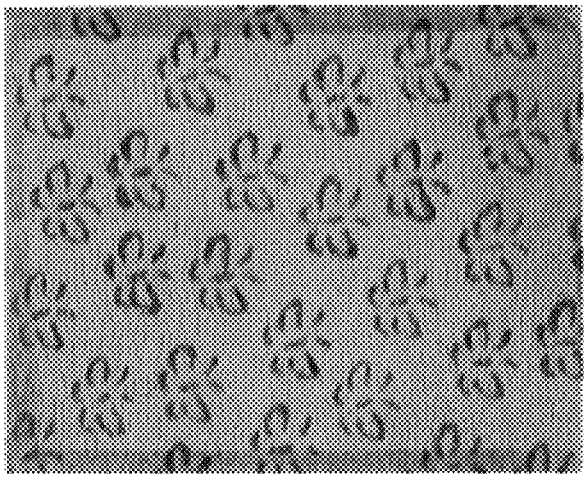

In order to produce a product with improved strength, the hand sheet produced in this example was couched to a second sheet of long fiber having no pattern. This was accomplished by placing the decorative hand sheet onto a second sheet formed on a continuous pilot tissue machine. The hand sheet was placed on the second sheet immediately after the forming process of the second sheet. The hand sheet was carried by the second sheet through the remaining pressing, drying and creping operations. FIG. 8 is a photograph of the hand sheet couched to the second sheet. The end result was a tissue web consisting of two layers, one having a decorative pattern and the second layer made up of a continuous network of long fibers for strength. The decorative pattern of the butterfly in the finished web was the result of a basis weight and fiber composition difference in the area of the butterfly design versus the remaining area of the web. The butterfly design consisted of a low basis weight and contained only long fibers from the strength layer. The remaining areas of the sheet were of higher basis weight and contained long fibers from the strength layer and short fibers from the decorative layer.

Example 3

Figure 9:
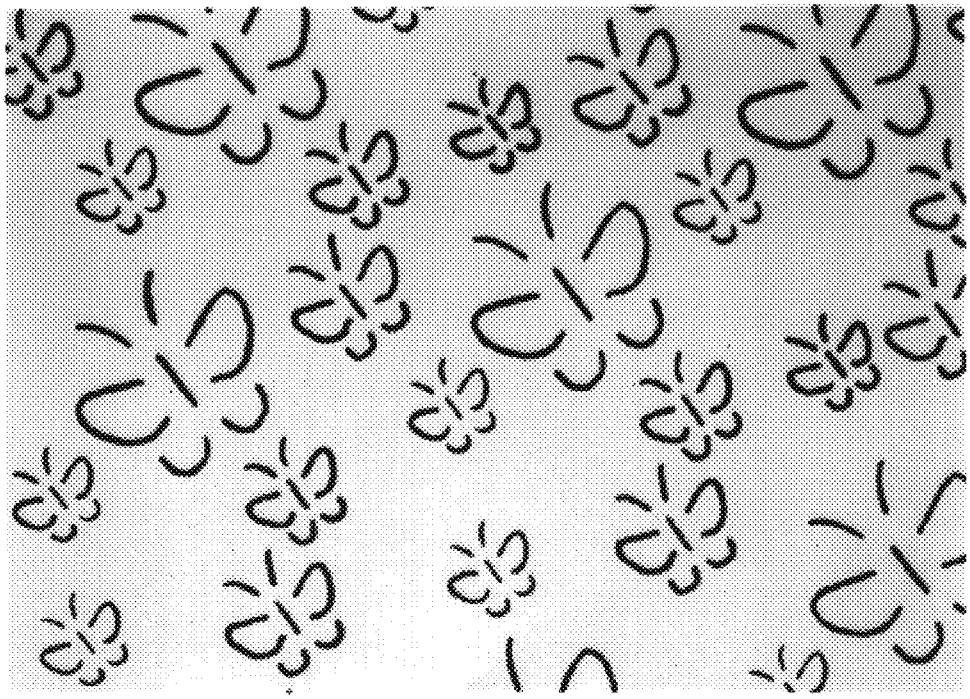

A couch-formed decorative tissue product was produced as illustrated in FIG. 4. Specifically, 100 percent eucalyptus pulp was hydropulped at 4 percent consistency. The fiber was pumped to the stock chest and diluted to 1 percent consistency and 2 pounds per ton Berocel 596 debonder was added. This stock chest provided the fiber for the decorative sheet on the top former. The fiber from the stock chest was pumped to the forming flow spreader and formed on the fabric at approximately 0.1 percent consistency. The forming fabric for the top former was an Appleton Wire 94M silk screened with a latex resin with the butterfly pattern shown in FIG. 9. The line width sealing the fabric to produce the butterfly design was approximately 1 mm. wide. The butterfly design was silk screened onto the fabric with the same process that designs are silk screened to clothing. A stencil of the pattern was produced, placed on top of the fabric and latex resin was forced through the stencil and embedded into the fabric to seal and restrict the drainage of the fabric in the area of the pattern. The viscosity of the resin must be fluid enough to enter the fabric but not so viscous as to migrate freely through the fabric and not retain the crisp pattern image.

The bottom former also had an Appleton Wire 94M forming fabric with no pattern. 100 percent northern softwood kraft pulp was hydropulped at 4 percent consistency. The fiber was refined in a single disk refiner between 3 percent and 4 percent consistency at a gap of 0.003 inch. The fiber was then pumped to a second stock chest and diluted to 1 percent consistency. The fiber from the second stock chest provided fiber for the bottom former and again the fiber was pumped to the forming flow spreader and formed on the fabric at approximately 0.1 percent consistency.

Figure 10:
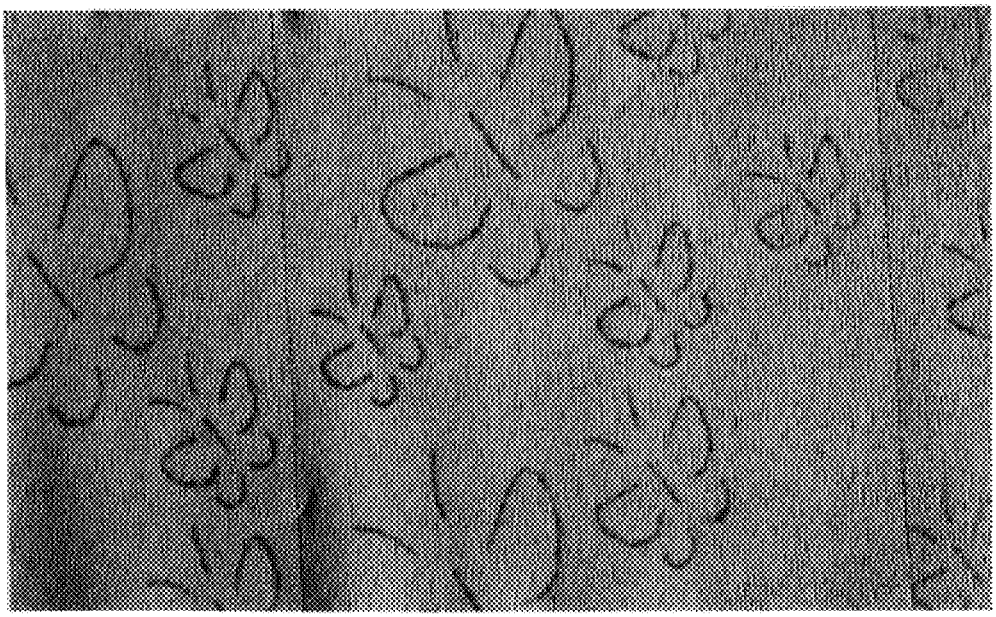

A 15.9 gram per square meter dryer basis weight sheet of 100 percent eucalyptus was formed on the top former and vacuum dewatered to approximately 10 percent consistency. A 6.8 gram per square meter dryer basis weight sheet of 100 percent northern softwood kraft was formed on the bottom former and vacuum dewatered to approximately 10 percent consistency. The sheet from the top former was then transferred to the sheet and fabric of the bottom former to produce a single web of 22.7 grams per square meter total dryer basis weight. The web was vacuum transferred to an Albany Duramesh felt and carried to the Yankee dryer. The web was wet pressed and transferred by a pressure roll to the Yankee dryer. The web was dried to approximately 90 to 95 percent consistency and creped. The machine configuration resulted in the sheet from the top former (decorative sheet) located against the felt and on the air side of the dryer during creping. Like Example 2, the decorative pattern in the web was a result of basis weight and fiber composition difference between the line components of the butterfly pattern and the remaining sheet. A photograph of the resulting tissue is illustrated in FIG. 10.

Example 4

Figure 11:
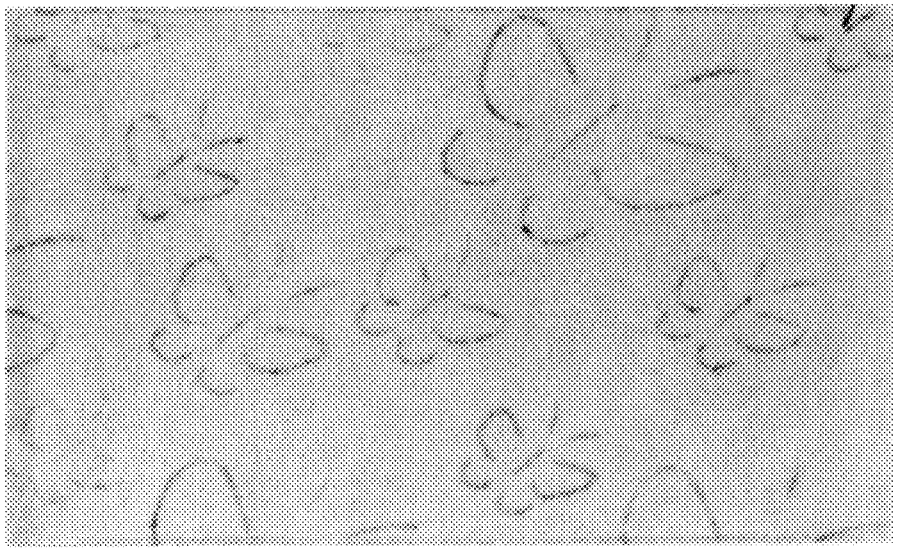

To show that the process of decorative forming is not limited to the couch forming process, a sample was produced with a single-layer, blended furnish. The same decorative forming fabric with the butterfly design shown in FIG. 9 and used in Example 3 was used for this example. A furnish of 50 percent eucalyptus having 2 pounds per ton Berocel 596 debonder and 50 percent refined northern softwood kraft was blended in the stock chest and diluted to 1.0 percent consistency. A 22.7 grams per square meter basis weight blended sheet was formed on the decorative fabric at 0.1 percent consistency. The sheet was vacuum dewatered to approximately 10 percent consistency and transferred to an Albany Duramesh felt. The web was wet pressed and transferred to the Yankee dryer, dried and creped. The resulting web is shown in the photograph of FIG. 11.

As seen earlier, the decorative pattern in the sheet was due to basis weight and fiber composition differences between the line components of the pattern and the rest of the base sheet controlled by the drainage of the fabric. The line width of the sealed components of the butterfly pattern was approximately 1 millimeter.

The fiber length distribution of the northern softwood kraft furnish, as tested by the Kajaani Fiber Analyzer, showed that 50 percent of the fibers are longer than 1 millimeter. The Kajaani Fiber Analyzer showed that 94 percent of the eucalyptus furnish was shorter than 1 millimeter. The base sheet in this example was 50 percent northern softwood kraft, indicating that approximately 25 percent of the total number of fibers in the base sheet were longer than 1 millimeter and were capable of spanning the sealed line component of the pattern during the drainage process and retaining a continuum of fiber network to carry the strength of the sheet. Almost the entire eucalyptus furnish is shorter than the 1 millimeter line width and cannot span the sealed line of the pattern in the fabric. Also the drainage rate and flow through the fabric carried the shorter eucalyptus fiber away from the sealed line of the pattern and the fiber collected in the open drainage areas of the fabric. This resulted in a basis weight and fiber composition difference between the sealed line components of the pattern and the remaining areas of the sheet.

Example 5

Figure 12:
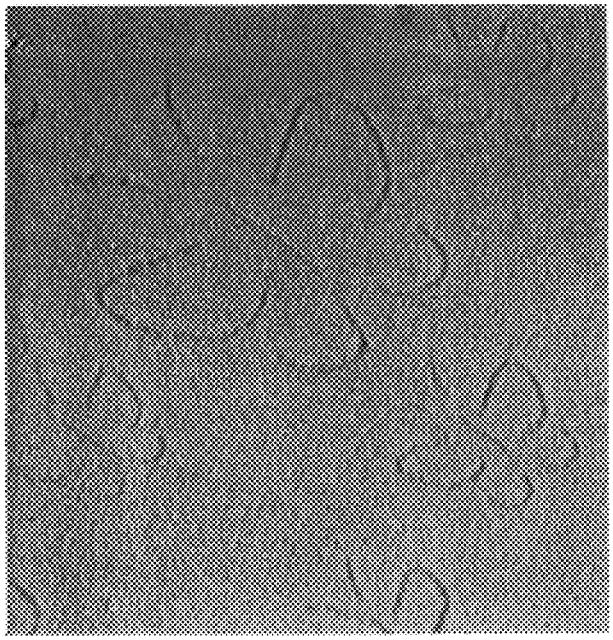
Figure 13:
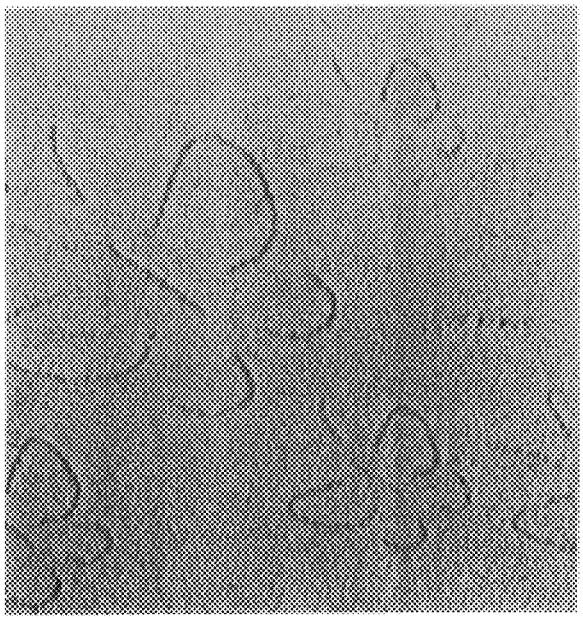

When using the couch forming process, the decorative pattern can be enhanced by placing cationic dyes in the different layers of the sheet. Three combinations of dye were tried using the process described in Example 3: (1) the decorative eucalyptus layer was colored blue and the strength layer was not dyed; (2) the decorative eucalyptus layer was not dyed and the strength layer was colored blue; and (3) both layers were colored blue but the strength layer had twice the concentration of dye of the decorative layer. All three combinations enhanced the visual perception of the pattern, with the last combination of both layers colored at different concentrations having the greatest pattern perception. FIG. 12 is a photograph of a tissue having no dye. FIG. 13 is a photograph of a tissue having dye in both layers with a greater concentration of dye in the strength layer.

Example 6

Figure 14:
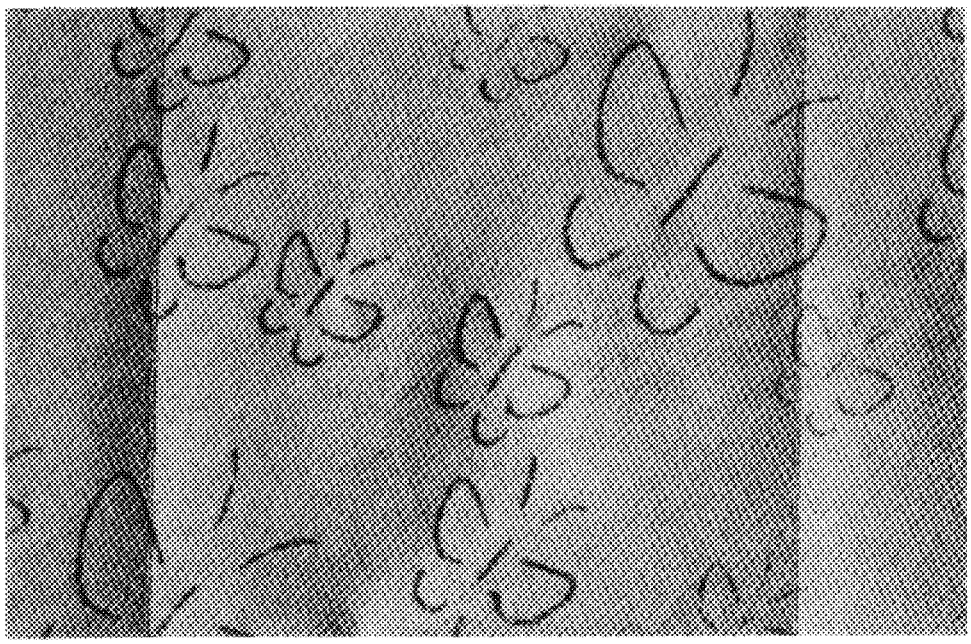

The decorative formed sheet having dyes of different concentration in the two layers described in Example 5 was microembossed with a set of laser-engraved male/female matched embossing rolls. As expected, the microembossing process generated bulk at the expense of lowering the tensile strength. The visual aesthetics of the decorative pattern did not change due to the embossing process. This example demonstrates that since the decorative pattern is casted into the sheet during the forming process and exists due to a basis weight and fiber composition difference in the sheet, any post treatment to the web such as embossing and calendering will not change the visual appearance of the pattern. FIG. 14 is a photograph of the resulting embossed tissue.

Example 7

A decoratively-formed tissue sheet was produced as illustrated in FIG. 4. More specifically, 100 percent northern softwood kraft pulp was hydropulped at 4 percent consistency. The fiber was refined in a single disk refiner between 3 and 4 percent consistency at a gap of 0.003 inch. The fiber was pumped to the stock chest and diluted to 1 percent consistency and 0.25 percent Kymene 557LX was added. This stock chest provided fiber for the top former. The fiber from the stock chest was pumped to the forming flow spreader and formed on the fabric at approximately 0.1 percent consistency. The forming fabric for the top former was an Appleton Wire 94M.

Figure 15:
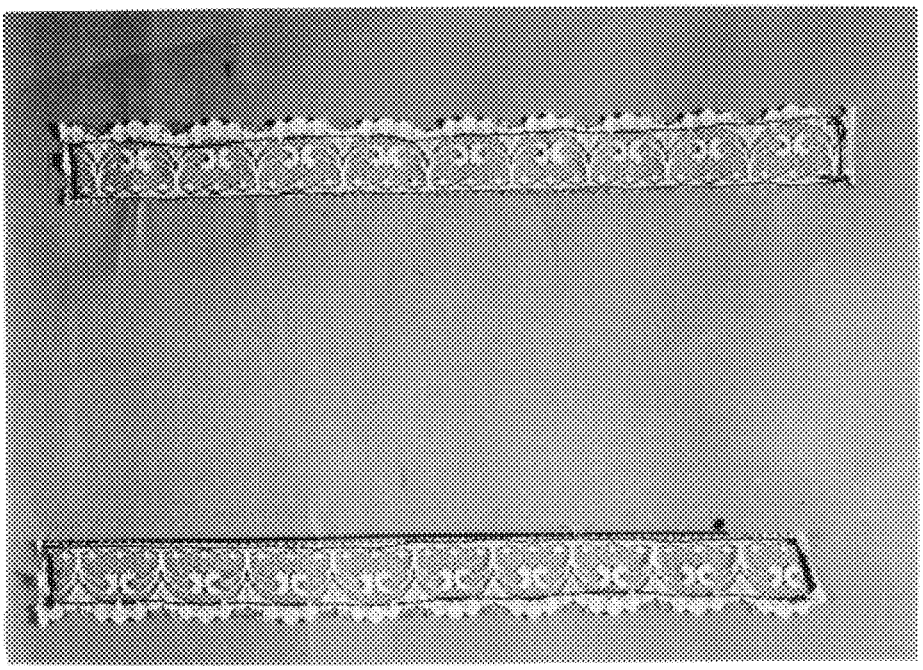
Figure 16:
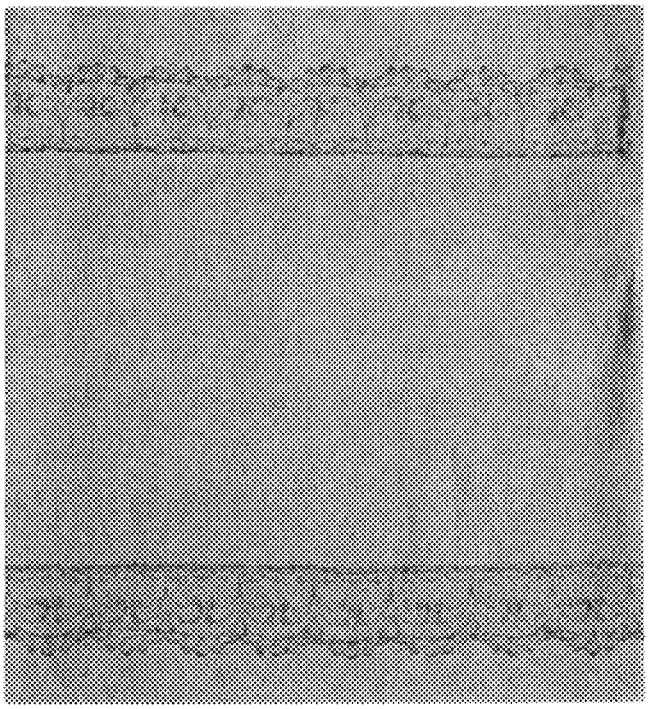
Figure 17:
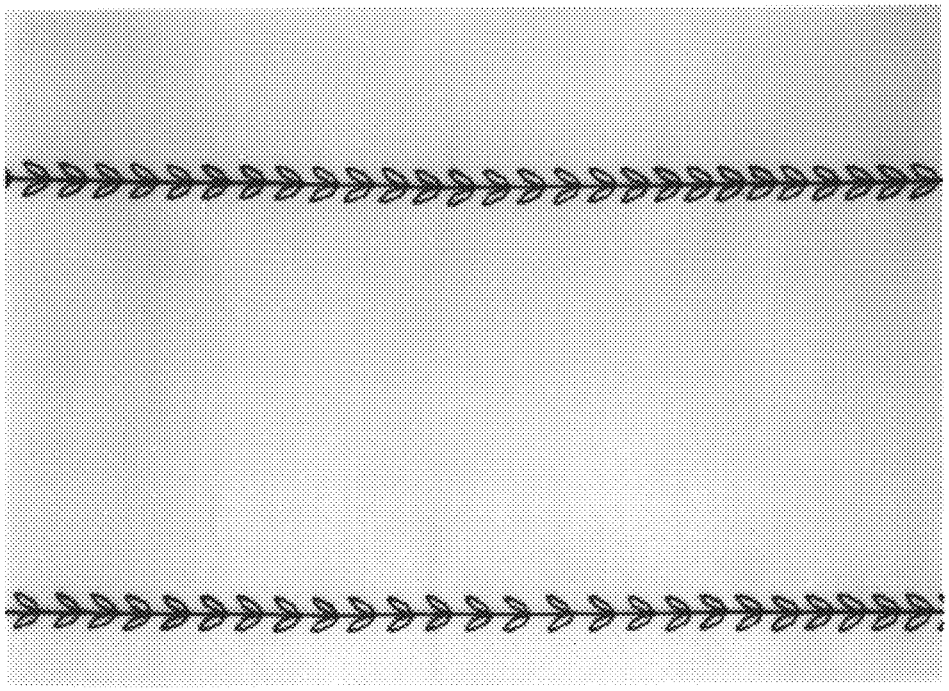

100 percent eucalyptus pulp was hydropulped at 4 percent consistency for 15 minutes. The fiber was pumped to the stock chest and diluted to 1 percent consistency. This stock provided fiber for the decorative sheet on the bottom former. The forming fabric for the bottom former was an Appleton Wire 94M with strips of lace border sewed on it. FIG. 15 is a photograph of the forming fabric with the lace border. FIG. 16 is the resulting tissue. Embroidery or stitching a pattern on a forming fabric was also trialed. FIG. 17 is a photograph of the forming fabric with the stitched border.

Figure 18:
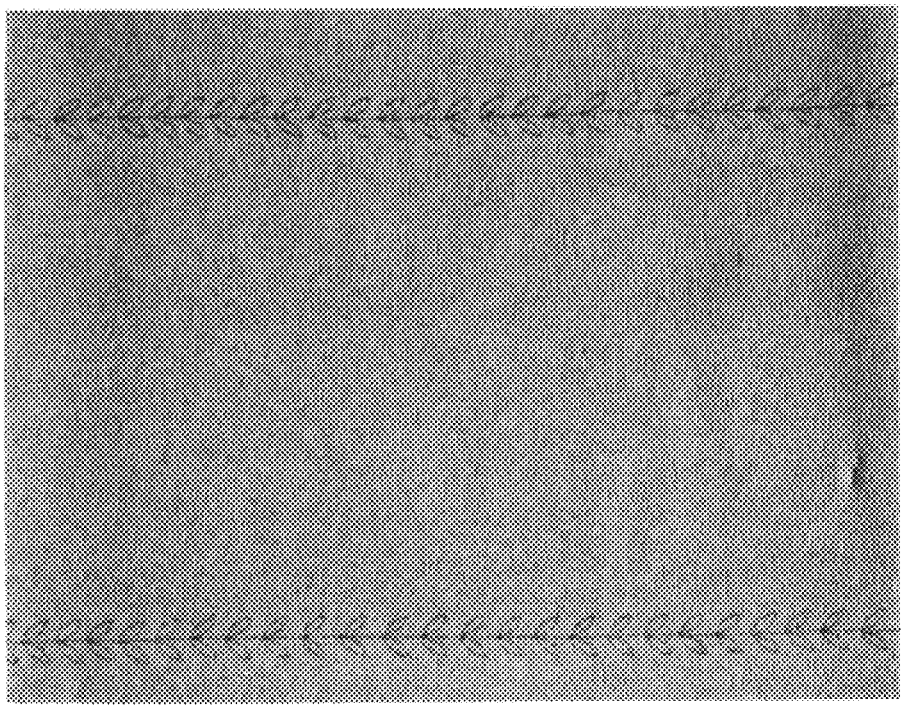

FIG. 18 is the resulting tissue.

Example 8

A decoratively-formed tissue sheet was produced as illustrated in FIG. 4. More specifically, 100 percent northern softwood kraft pulp was hydropulped at 4 percent consistency for 60 minutes. The fiber was pumped to the stock chest and diluted to 1 percent consistency and 0.25 percent Kymene 557LX was added. This stock chest provided fiber for the top former. The fiber from the stock chest was pumped to the forming flow spreader and formed on the fabric at approximately 0.1 percent consistency. The forming fabric for the top former was an Appleton Wire 94M.

Figure 19:
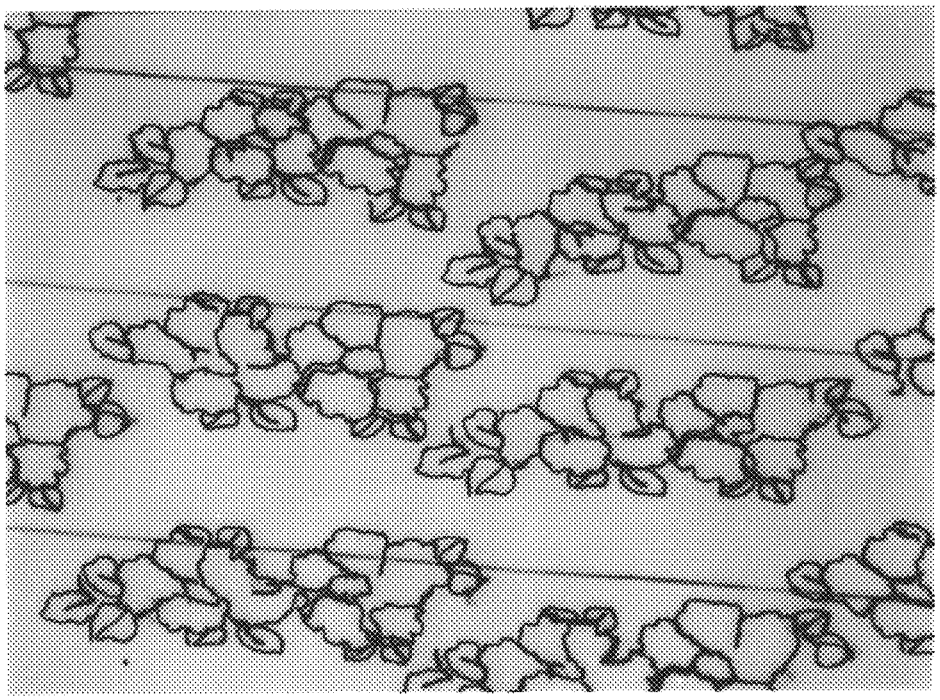
Figure 20:
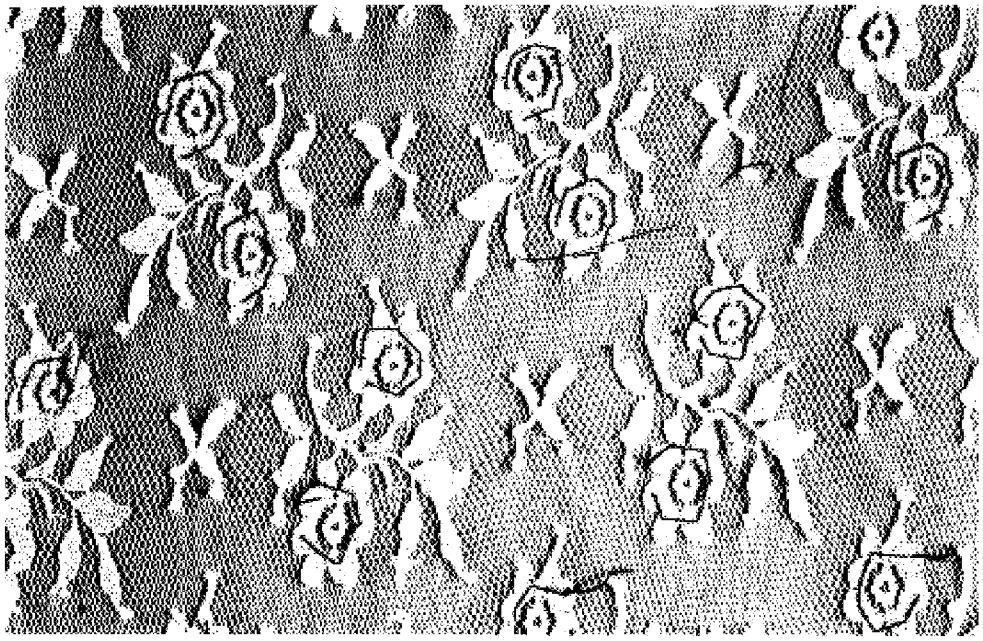
Figure 21:
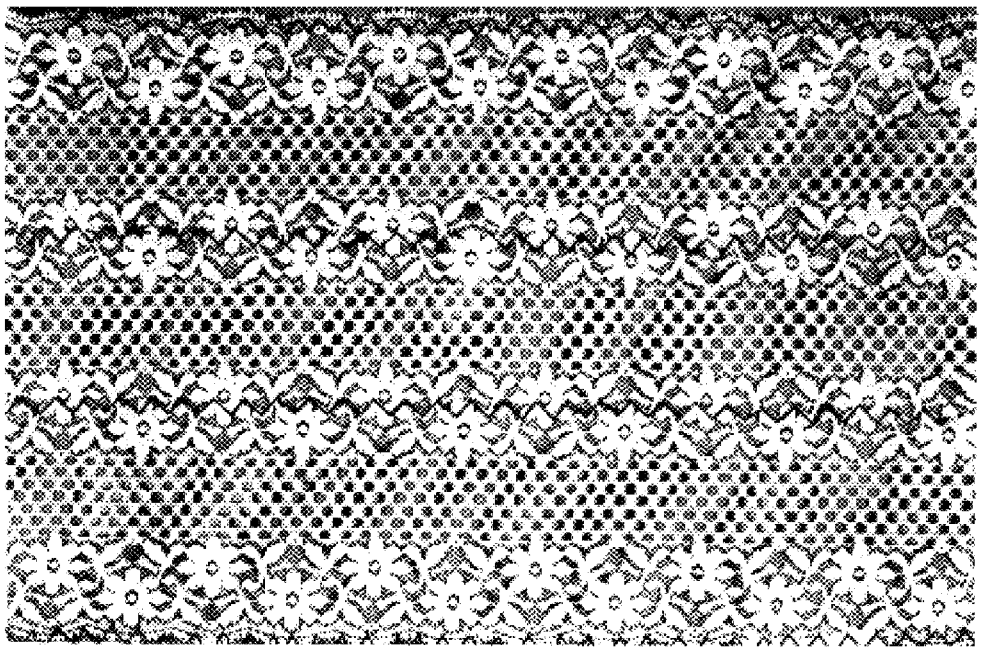
Figure 22:
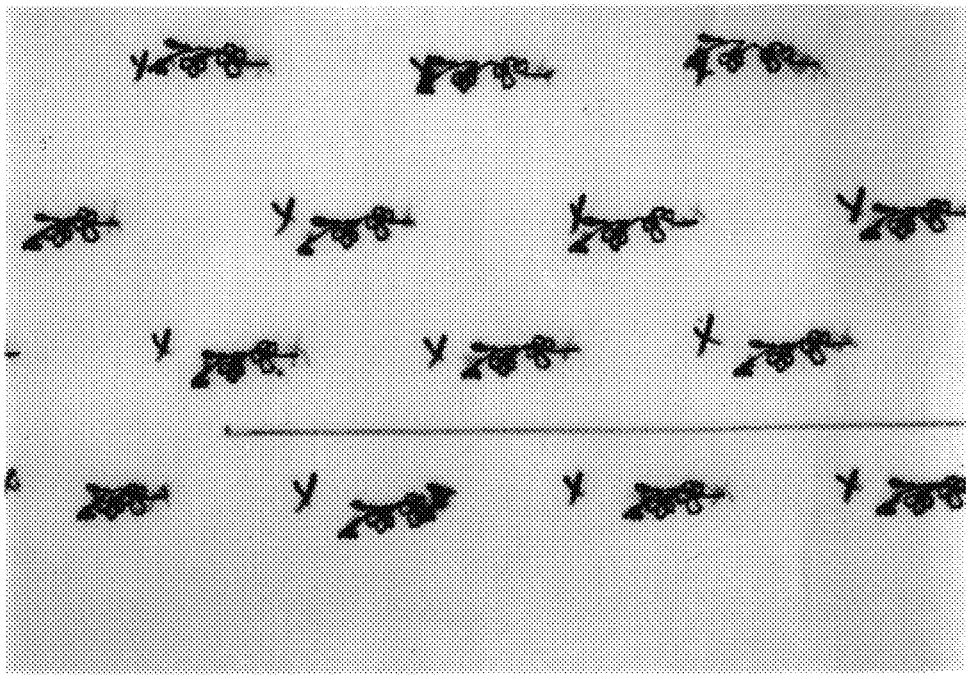
Figure 23:
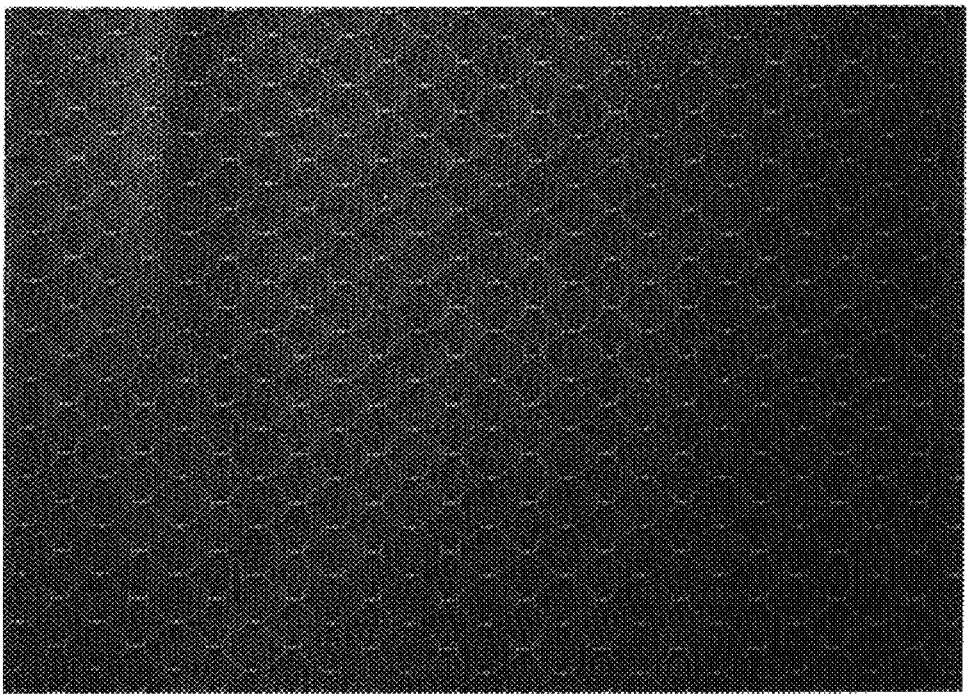
Figure 24:
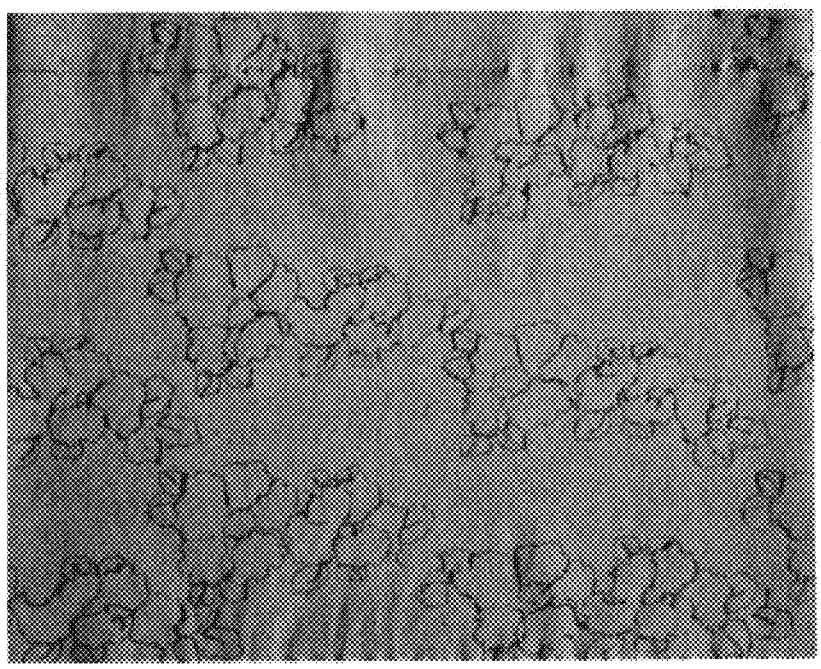
Figure 25:
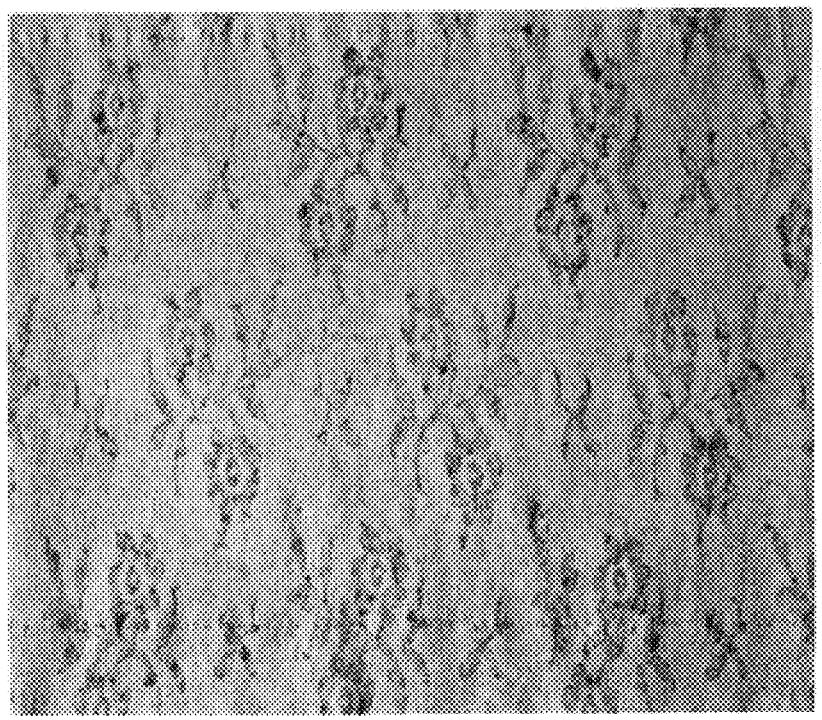
Figure 26:
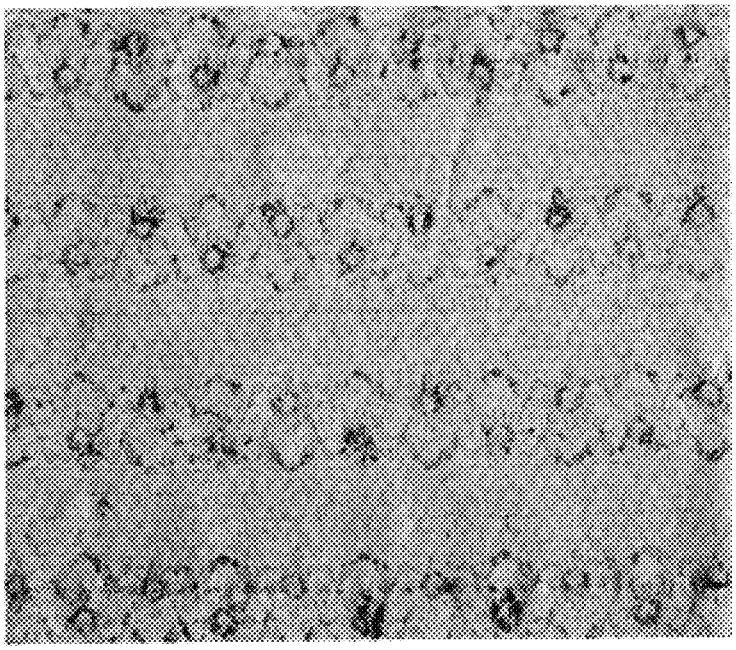
Figure 27:
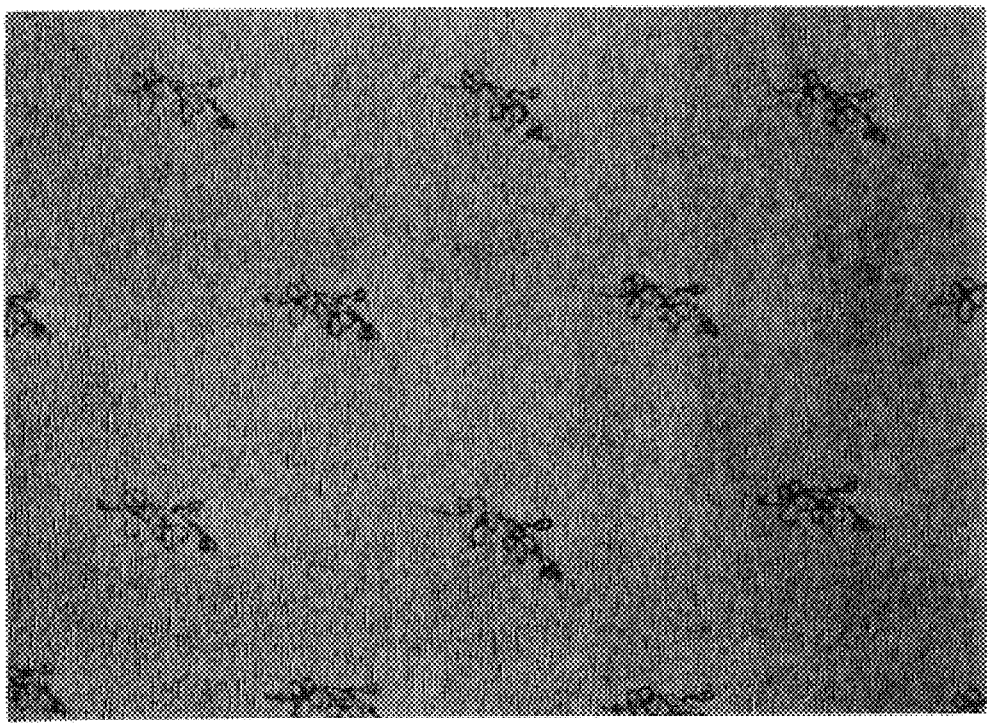
Figure 28:
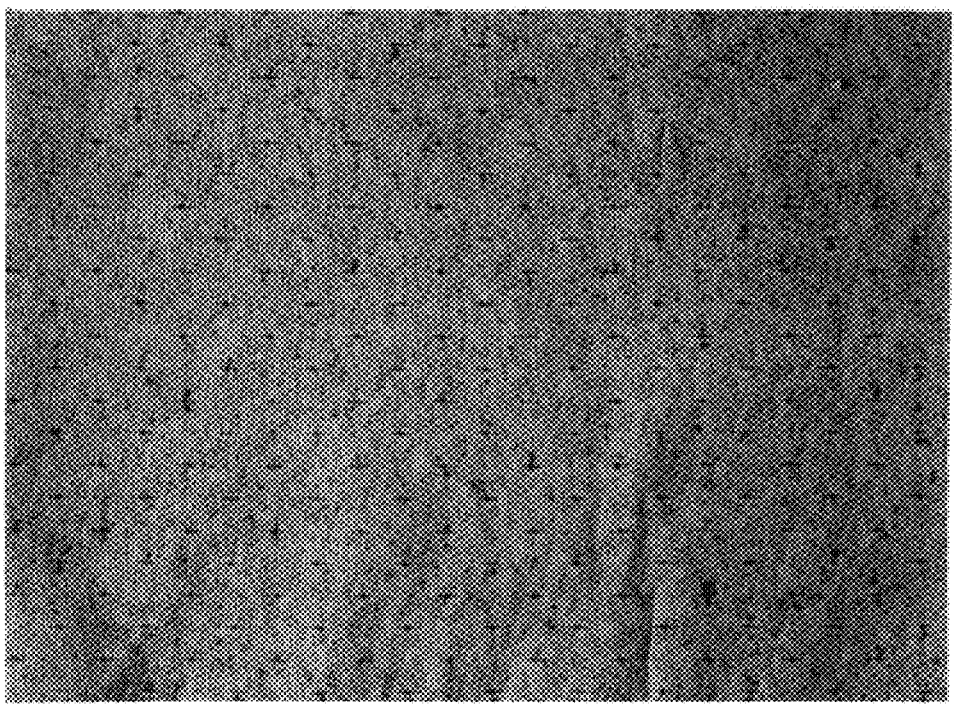

100 percent eucalyptus pulp was hydropulped at 4 percent consistency for 15 minutes. The fiber was pumped to the stock chest and diluted to 1 percent consistency. The forming fabric for the bottom former was an Appleton Wire 94M with five different decorative patterns. The patterns consisted of (1) A wild rose pattern that was stitched or embroidered on the forming fabric. The wild rose pattern is shown in FIG. 19; (2) An overall floral pattern that consisted of a large piece (approximately 15 inches×36 inches) of lacy fabric that was sewn onto the forming fabric. The overall floral pattern is shown in FIG. 20; (3) A line floral pattern that consisted of a large piece (approximately 15 inches×36 inches) of lacy fabric that was sewn onto the forming fabric. The overall line floral pattern is shown in FIG. 21; (4) A small floral pattern that was stitched or embroidered on the forming fabric. The small floral pattern is shown in FIG. 22; (5) A dot pattern that consisted of a large piece (approximately 15 inches×36 inches) of lacy fabric that was sewn onto the forming fabric. The dot pattern is shown in FIG. 23.

A 3.8 grams per square meter dryer basis weight sheet of 100 percent northern softwood kraft was formed on the top former and vacuum dewatered to approximately 10 percent consistency. An 8.9 grams per square meter dryer basis weight sheet of 100 percent eucalyptus was formed on the bottom former and vacuum dewatered to approximately 10 percent consistency. The sheet from the top former was then transferred to the sheet and fabric of the bottom former to produce a single web of 12.7 grams per square meter total dryer basis weight. The web was vacuum transferred to an Albany Duramesh felt and carried to the Yankee dryer. The web was wet pressed and transferred by a pressure roll to the Yankee dryer. The web was dried to approximately 90 to 95 percent consistency and creped. This machine configuration results in the sheet from the top former located against the felt and on the air side of the dryer during creping. The bottom former (decorative sheet) was located on the air side of the felt and was against the Yankee dryer during creping. FIGS. 24–28 are photographs of the resulting sheets with the decorative patterns (1–5) described above, respectively.

Example 9

A decoratively-formed tissue sheet was formed as illustrated in FIG. 4. More specifically, 100 percent northern softwood kraft pulp was hydropulped at 4 percent consistency for 60 minutes. The fiber was pumped to the stock chest and diluted to 1 percent consistency and 0.25 percent Kymene 557LX was added. This stock chest provided fiber for the top former. The fiber from the stock chest was pumped to the forming flow spreader and formed on the fabric at approximately 0.1 percent consistency. The forming fabric for the top former was an Appleton Wire 94M.

Figure 29:
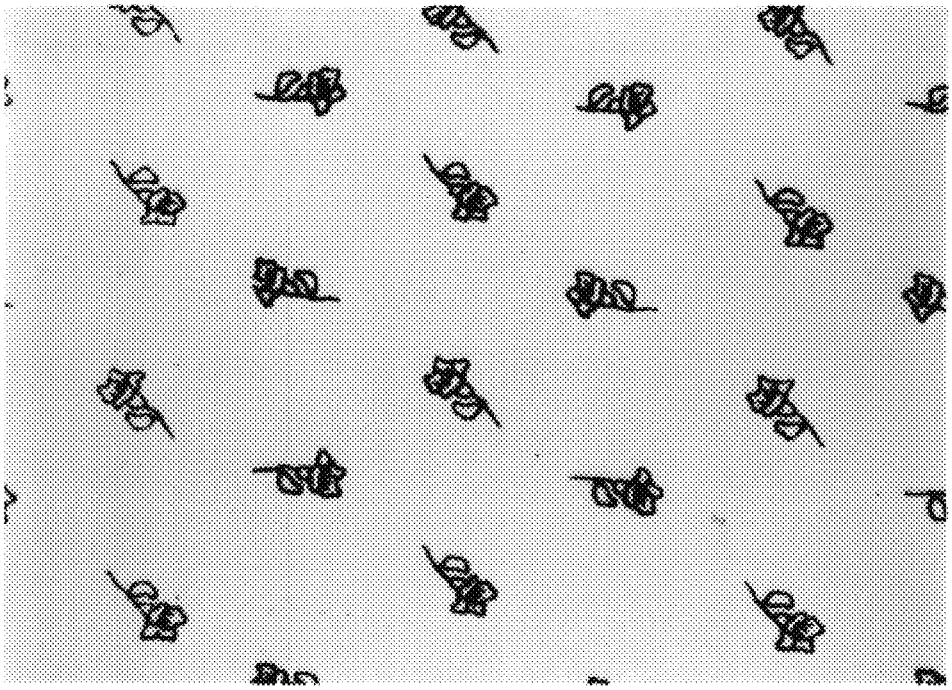

100 percent eucalyptus pulp was dispersed with a hydro pulper at 4 percent consistency for 15 minutes. The fiber was pumped to the stock chest and diluted to 1 percent consistency. This stock provided fiber for the decorative sheet on the bottom former. The forming fabric for the bottom former was an Appleton Wire 94M silk screened with a lily floral pattern shown in FIG. 29. The line width sealing the fabric to produce the lily design was approximately 1 millimeter wide. The lily design was silk screened onto the fabric with the same process that designs are silk screened to clothing, etc. The sealing of the forming fabric restricted the drainage, thus altering the fiber distribution of the sheet to create the desired pattern.

Figure 30:
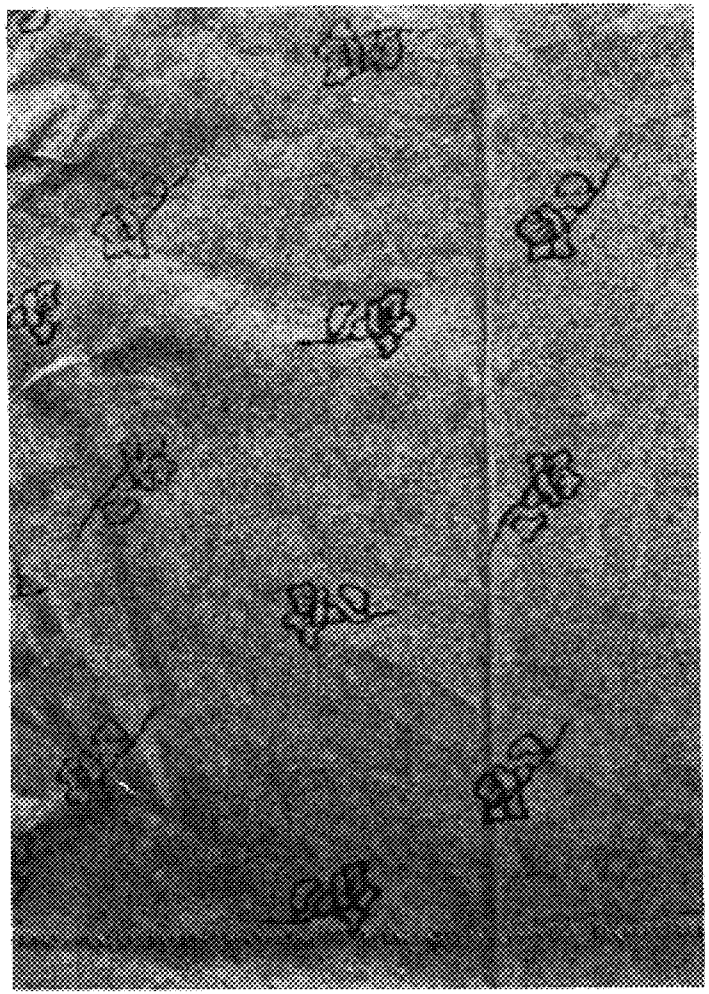
Figure 31:
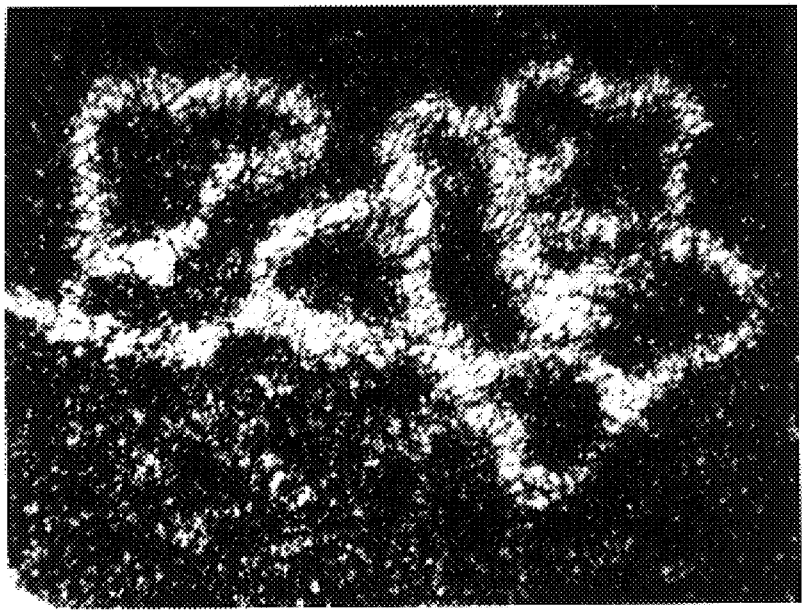

A 5.09 grams per square meter dryer basis weight sheet of 100 percent northern softwood kraft was formed on the top former and vacuum dewatered to approximately 10 percent consistency. A 6.78 grams per square meter dryer basis weight sheet of 100 percent eucalyptus was formed on the bottom former and vacuum dewatered to approximately 10 percent consistency. The sheet from the top former was then transferred to the sheet and fabric of the bottom former to produce a single web of 11.87 grams per square meter total dryer basis weight. The web was vacuum transferred to an Albany Duramesh felt and carried to the Yankee dryer. The web was dried to approximately 90 to 95 percent consistency and creped. This machine configuration resulted in the sheet from the top former being located against the felt and on the air side of the Yankee dryer during creping. FIG. 30 is a photograph of the resulting sheet with the lily floral pattern. FIG. 31 is a photograph of the same tissue sheet at 10×magnification using transmitted light to illustrate the basis weight and fiber composition difference between the decorative areas of the lily and the adjacent background area of the tissue.

Example 10

A decoratively-formed tissue was formed as illustrated in FIG. 5. This forming configuration is commonly referred to as a crescent former. More specifically, 100 percent northern softwood kraft pulp was disintegrated with a hydropulper at 2 percent consistency for 25 minutes. The fiber was pumped to the stock chest and diluted to 1.14 percent consistency. This stock chest provided fiber for the upper layer of the layered headbox.

100 percent eucalyptus pulp was disintegrated with a hydropulper at 4 percent consistency for 25 minutes. The fiber was pumped to the stock chest and diluted to 2.4 percent consistency. This stock provided fiber for the bottom layer of the layered headbox. The forming fabric was an Appleton Wire 94M silk screened with a lily floral pattern shown in FIG. 29.

The bottom layer of the tissue consisted of 100 percent eucalyptus and had a 4.88 grams per square meter dryer basis weight. The top layer of the tissue consisted of 100 percent northern softwood kraft and had a 7.32 grams per square meter dryer basis weight to produce a single web of 12.2 grams per square meter total dryer basis weight. The web was vacuum transferred to an Albany Duramesh felt and carried to the Yankee dryer. The web was dried to approximately 90 to 95 percent consistency and creped. The resulting sheet had 1179 grams MD-Dry tensile with 30.6 percent stretch and 608 grams CD-Dry tensile with 7.0 percent stretch. Machine speed for this example was 2500 feet per minute.

It will be appreciated that the foregoing description and examples, given for purposes of illustration, are not to be construed as limiting the scope of this invention, which is defined by the following claims and all equivalents thereto.

We claim:

1. A tissue sheet having a distinct decorative pattern comprising curvilinear lines having a line width of from about 0.02 to about 2 millimeters cast into the sheet during its initial formation, said tissue sheet comprising long papermaking fibers and short papermaking fibers, wherein the decorative pattern is defined by areas having a greater average fiber length and a lower basis weight than the surrounding adjacent area of the tissue sheet.

2. The tissue sheet of claim 1 comprising softwood and hardwood fibers, wherein the decorative area of the sheet has a greater percentage of softwood fibers than the surrounding adjacent area of the tissue sheet.

3. The tissue sheet of claim 2 wherein the decorative area of the sheet is substantially all softwood fibers.

4. The tissue sheet of claim 1 having first and second layers, wherein the first layer is an outer layer containing predominantly short fibers and containing decorative areas of low basis weight compared to the basis weight of the balance of the layer, and wherein said second layer contains predominantly long fibers and has a substantially uniform basis weight distribution.

5. The tissue sheet of claim 4 wherein the fibers of the second layer are colored differently than the fibers of the first layer.

6. The tissue sheet of claim 1 wherein the shape of the decorative pattern is selected from the group consisting of flowers, butterflies, leaves, animals, toys, and words and monograms.

7. A unitary tissue sheet comprising first and second layers, wherein said first layer contains a decorative pattern defined by areas of relatively low basis weight surrounded by a continuum of relatively high basis weight and wherein said second layer is of substantially uniform basis weight.

8. The tissue sheet of claim 1 wherein the line width is from about 0.05 to about 1.5 millimeters.

9. The tissue sheet of claim 1 wherein the majority of the lines are substantially parallel to the cross-machine direction of the tissue sheet.

10. A tissue sheet of substantially uniform density having a distinct decorative pattern cast into the sheet during its initial formation, said tissue sheet comprising long papermaking fibers and short papermaking fibers, wherein the decorative pattern is defined by areas having a greater average fiber length and a lower basis weight than the surrounding adjacent area of the tissue sheet.

11. The tissue sheet of claim 10 wherein the decorative pattern comprises curvilinear lines having a line width of from about 0.02 to about 2 millimeters.

12. The tissue sheet of claim 11 wherein the line width is from about 0.05 to about 1.5 millimeters.

* * * * *